United States Patent [19]

Salomon

[11] 4,186,501

[45] Feb. 5, 1980

[54] SKI BOOT

[75] Inventor: Georges P. J. Salomon, Annecy, France

[73] Assignee: S.A. Etablissements Francois Salomon & Fils, Annecy, France

[21] Appl. No.: 852,367

[22] Filed: Nov. 16, 1977

[51] Int. Cl.[2] ..... A43B 5/04

[52] U.S. Cl. ..... 36/121

[58] Field of Search ..... 36/117, 118, 119, 120, 36/121, 50

[56] References Cited

U.S. PATENT DOCUMENTS

| | | | |
|---|---|---|---|
| 3,968,578 | 7/1976 | Rathmell | 36/121 |
| 3,975,838 | 8/1976 | Martin | 36/121 |

FOREIGN PATENT DOCUMENTS

| | | | |
|---|---|---|---|
| 2262453 | 2/1974 | Fed. Rep. of Germany | 36/121 |
| 2451613 | 7/1975 | Fed. Rep. of Germany | 36/121 |

*Primary Examiner*—Patrick D. Lawson

*Attorney, Agent, or Firm*—Haseltine, Lake & Waters

[57] ABSTRACT

A ski boot made in two parts comprising an upper and a lower part, which co-operate by means of at least one deformation area provided on one of the two parts. A resilient attachment has two states provided for controlling the deformation of the area, namely a first state in a position of the boot suitable for skiing, in which it ensures the locking, at least rearwards, of the upper part on the lower part, and a second state, in a position of the boot suitable for walking, in which by its sole operation it allows at least partial elimination of the co-operation between the deformation area provided on one of the parts with the other part, as well as elimination of the aforesaid locking operation.

9 Claims, 11 Drawing Figures

FIG.8
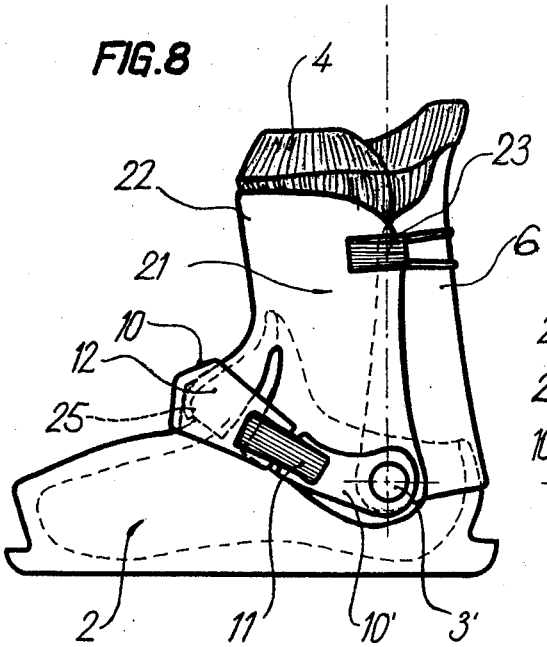
FIG.9
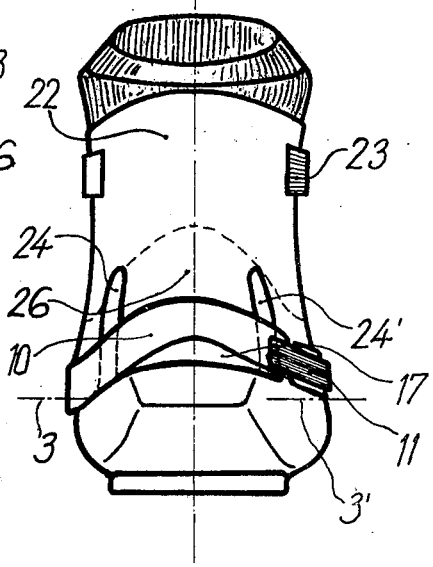
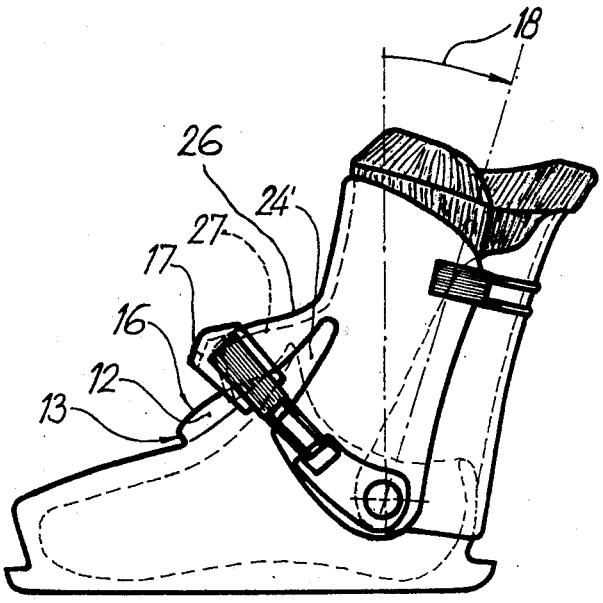
FIG.10

SKI BOOT

FIELD OF THE INVENTION

The present invention relates to a novel structure of a ski boot and more precisely of a ski boot whose leg portion is pivoted on the foot portion in the area of the ankles in order to facilitate walking. In fact, it is well known that current ski boots are not suited to walking as regards the anatomy, or to driving a motor vehicle, nor to a normal upright stance which is necessary for proceeding to or waiting at the access points to mechanical ski lifts.

PRIOR ART

To fulfil this requirement, while preserving the characteristics for carrying out skiing, inherent in current ski boots, ski boots have already been produced, which owing to a combination of means, have the properties necessary for skiing and walking.

Certain of these ski boots are generally composed of a leg portion and foot portion pivoted in the region of the ankles along the tibio-tarsal axis. However, in most cases, the range of movements offered by this type of boot allows only limited backwards bending and extension of the foot for normal walking, made all the more hazardous since the materials of the parts of the boots are only slightly elastic and the sole of these boots is generally flat.

Another type of boot having a tibio-tarsal articulation exists, the drawback of which consists of opening the leg portion and therefore of releasing the lower part of the leg, in order to facilitate the bending/extension movement of the foot, which causes painful friction for the skier when walking and makes the boot not waterproof in deep snow.

In addition, as regards these boots, it should be noted that, in order to obtain freedom for bending his legs, the skier is obliged to carry out several operations with hooks or other means. Thus, in the case of a known boot, the tibio-tarsal joint is released after the skier has bent forwards to remove a resilient wedge from between two rear abutments, then, after he has leaned rearwards to release a resilient ring retaining the abutments at the time of bending forwards and for pivoting the latter upwards. It will be seen that with this boot, it is also necessary to carry out several successive operations to achieve this freedom of the tibio-tarsal joint without needing to release the lower part of the leg.

SUMMARY OF THE INVENTION

An object of the present invention is to provide a boot which remedies the drawbacks of existing boots described above.

To this end, this ski boot composed of at least two parts, respectively a lower and upper part pivoted to each other, such as a foot portion and a leg portion composed of one or several members, is characterized in that the two parts of the boot co-operate by means of at least one deformation area provided on one of the two parts and in that resilient means are provided for controlling the deformation of said area, said means having two states, namely a first state, in a position suitable for skiing, in which it ensures locking, at least towards the rear, of the upper part on the lower part, and a second state, in a position suitable for walking, in which it facilitates, by solely operating the latter, at least partial elimination of the co-operation between the deformation area provided on one of the parts with the other part, as well as the elimination of the aforesaid locking.

According to an additional feature of the invention, the deformation area is advantageously produced, for example, either by at least one slot in the leg portion open from its lower periphery, or by at least one area of lesser thickness of material, the configuration of which is similar to that of the aforesaid slot.

By resilient means such as straps, hooks, independent of tightening the support for the leg or foot, it is possible on the one hand, during skiing and when bending forwards, to control the deformation of said deformable area and to ensure, on the basis of the co-operation of the resilient means and deformation area, locking of the movement of the leg when leaning back and on the other hand, according to the invention, when disconnecting the resilient means from the deformation area, in a single operation, one simultaneously releases the rear support and the co-operation of the bottom of the leg portion with the foot portion, thus producing the release of the tibio-tarsal joint necessary for walking. The additional advantage of the boot according to the invention resides in the fact that since tightening of the resilient means is independent of the means for tightening the support for the lower part of the leg and foot, the latter are kept in the closed position thus ensuring increased support and comfort of the boot when walking.

Thus, by means of the invention, a ski boot is produced which, by virtue of its design, is also suited to walking. In fact, unlocking by a single operation of the resilient means for controlling the deformation area makes it possible to pass at once from the skiing position to the walking position, while maintaining excellent support for the lower part of the leg and foot.

According to a preferred embodiment, the boot is composed of a foot portion to which a leg portion is pivoted, which leg portion is itself composed of a front part and a rear part interconnected by a tightening strap surrounding the latter. The foot portion is designed with a protuberance in the area of the top of the foot serving as a stop member for the rear support abutment corresponding to the bottom of the leg portion bordering the deformation area. The deformation area is constituted by a partial slot open from the lower periphery of the front part of the leg portion. Bringing together the inner edges of the slot and the rear support abutment is ensured by the closure of the resilient means, such as for example straps made of elastomer with hook systems, traction springs with a closure device of the toggle type etc.

According to another embodiment, similar to that aforedescribed, the deformation area is formed by two or more slots, also open from the lower periphery of the front part of the leg portion.

According to yet another embodiment similar to the former, the deformation area is constituted by at least one area of lesser thickness of material, which may be different from that of the front part of the leg portion and possibly forming a gusset. For all these embodiments, as a variation, it is also possible to have boots whose leg portion is constituted by a single part. For boots constituted by a leg portion which is in one-piece and has a rear opening for example, one provides one or more deformation areas located laterally with respect to the foot and still starting at the lower periphery of the leg portion. In the case of a side opening, the deformation area is located on the side opposite said opening. Clearly, resilient control means corresponding to each deformation area will be adapted in an adequate manner to each variation.

BRIEF DESCRIPTION OF THE DRAWINGS

The invention will be described in detail with reference to two particular embodiments given as non-limiting examples and illustrated in the accompanying drawings.

FIG. 8 is an elevational view of the boot according to another embodiment of the invention, in the static rest position.

FIG. 9 is a front view of the boot according to FIG. 8.

FIG. 10 is an elevational view of the boot according to the embodiment of FIG. 8 in the position of rearwards extension of the foot.

DETAILED DESCRIPTION

Figure 1:
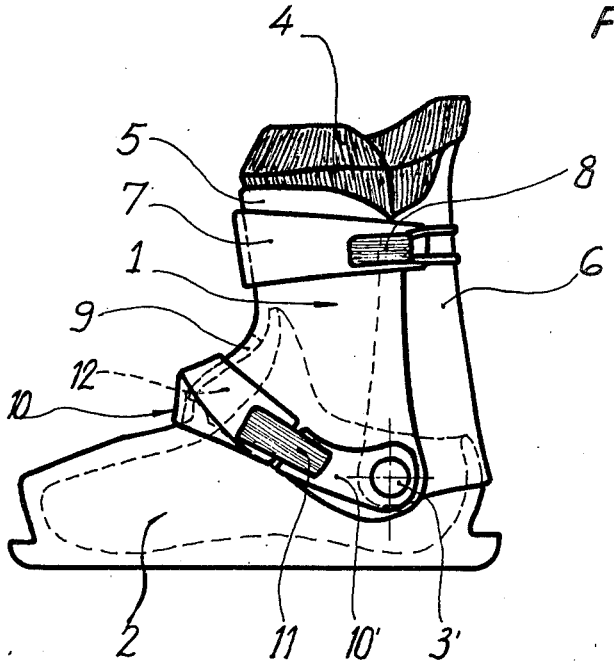
FIG. 1 is an elevational view of the boot according to a preferred embodiment of the invention, in the static rest position.

In the first embodiment of the invention (FIGS. 1 to 7), the ski boot comprises a leg portion 1, which is pivoted to a foot portion 2 by coaxial transverse pivots 3, 3' located in the region of the ankles.

The comfort and covering of the skier's foot are ensured by a sock 4 introduced into said boot. The leg portion 1 is composed of a front part 5 and a rear part 6, also known as a "spoiler", which ensure the support of the lower part of the leg by means of a strap 7 locked by closure means 8 (for example hooks). In its lower and front section, the front part 5 of the leg portion is provided with a central slot 9 normally located above the top of the foot, open from the lower periphery and extended upwards and rearwards, this slot providing a deformation area of the front part 5. This part also comprises, on either side of the central slot 9, a lower edge 14 serving as a stop member and which, for this purpose, is folded downwards and has a substantially L-shaped profile. Provided on either side of the central slot 9 and in the area on top of the foot is resilient means for controlling the deformation, which in the case of the embodiment presently described, is composed of a strap 10 of resilient material anchored on one side of the boot in the region of the pivot 3 and connected in a nondetachable manner, by a closure device 11 of the toggle type for example, to another strap 10', also of resilient material, which is pivoted on the other transverse pivot 3'. In its central part, the strap 10 comprises a straight section substantially of L-shape, which may be adapted to the L-shaped profile of the lower edge 14 of the front part 5, while covering the latter. Below the front and lower central area of the front part 5, where the central slot 9 is provided, the foot section 2 comprises, on its upper surface, a protuberance 12 approximately in the shape of a spherical segment, fulfilling the function of a ball-and-socket joint and which is limited at the front by a shoulder 13 acting as a support abutment. The protuberance 12 has an outer curved surface 16 which is in contact with the inner surface 15 of the front part 5 in the area of the top of the foot, i.e. that which surrounds the central slot.

Figure 2:
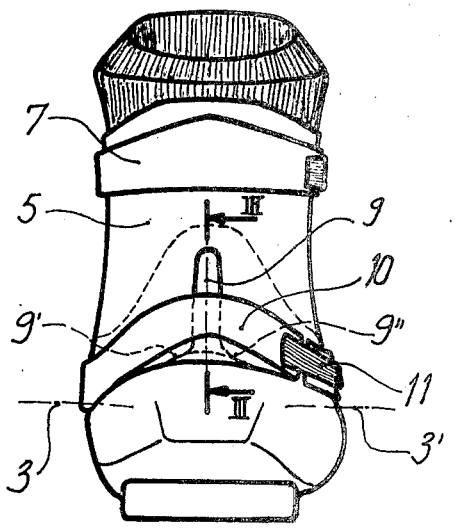
FIG. 2 is a front view of this same boot.
Figure 3:
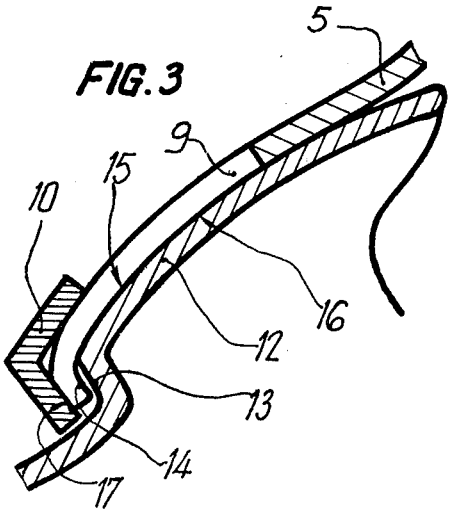
FIG. 3 is a sectional taken on line III—III in FIG. 2 and it shows in detail the means on the leg portion co-operating with that on the foot portion.

FIGS. 1 to 3 show the boot according to the preferred embodiment in the static rest position closed on the skier's foot, which is not shown. This position corresponds to a position for skiing which requires good support for the foot, as well as the ability to be able to bend forwards and/or lean back, as required by current skiing techniques. To do this, the resilient strap 10 is stretched over the deformation area of the front part 5 of the leg portion, illustrated by the slot 9, in order to bring the edges 9', 9'' of the latter together. The tension of the strap 10 is produced by closing the toggle device 11 fixed at its other end to the strap 10' itself anchored in the region of the pivot 3' of the leg portion. Bringing together the edges 9', 9'' thus obliges the lower edges 14, of L-shaped profile, located on either side of said slot 9, to lie flat against the rear support abutment 13 of the protuberance 12 whereas the inner side 15 of the front part 5 which conforms with the outer side 16 of the ball-and-socket joint 12, comes into contact with the latter. The L-shaped profile 17 of the strap 10 advantageously makes it possible to keep the deformable front part 5 and the ball-and-socket joint 12 comprising the abutment 13 in co-operation. Due to the tension produced by the closure of the strap 10 on the edges 9', 9'' of the slot 9, not only are these edges 9', 9'' moved towards each other, but also temporary deformation (at the time of the closure) of the bottom of the front part 5 of the leg portion occurs, which is thus compelled to lie flat against the ball-and-socket joint 12 and its abutment 13, said edges 9', 9'' being separated from each other and from the ball-and-socket joint 12 in the open position of said strap 10. Since the boot is thus fitted and closed on the skier's foot, when leaning back, the inner side 15 of the part 5 of the leg portion slides rearwards on the outer side 16 of the ball-and-socket joint 12 until the L-shaped edge 14 comes into contact with the abutment 13, thus producing a support for the lower part of the leg leaning rearwards. When leaning forward, due to bending of the leg, the leg portion 1 pivots about the pivots 3, 3' and the inner side 15 of the front part 5 thus slides forwards on the outer face 16 of the ball-and-socket joint 12. Consequently, the stop edge 14 moves away from the abutment 13 and as the bending movement continues, the edges 9', 9'' of the slot 9 separate in turn, on coming into contact with the top of the foot portion 2. However, the deformation of the bottom of the front part 5 resulting from the separation of the edges 9', 9'' is limited and controlled by the resilient strap 10 which covers said edges 9', 9'' and the stop edge 14. The progressive action of leaning forwards when the skier bends his leg is thus ensured by the elasticity of the strap 10 tensioned in the deformation area formed by the edges of the slot and by the friction of the edges 9', 9'' on the top of the foot portion.

Figure 4:
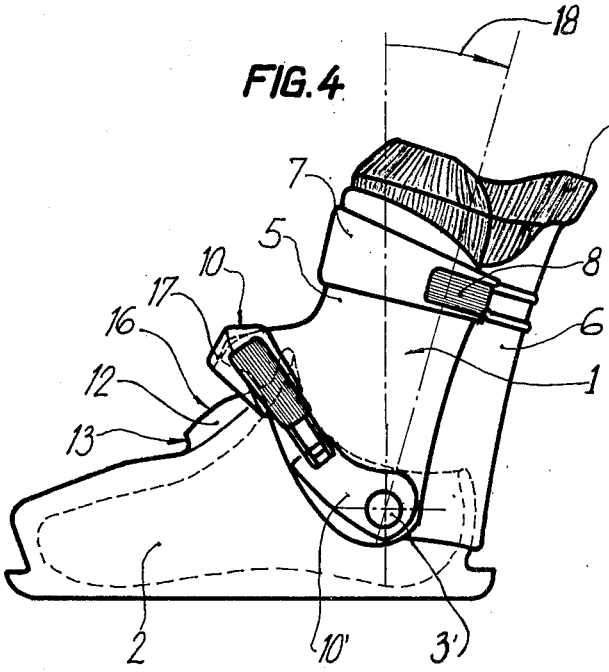
FIG. 4 is an elevational view of the boot according to the invention in the position of rearwards extension of the foot.
Figure 5:
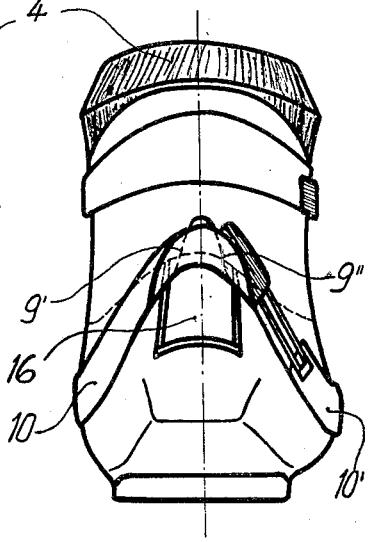
FIG. 5 is a front view of the boot in the position of rearwards extension of the foot.
Figure 6:
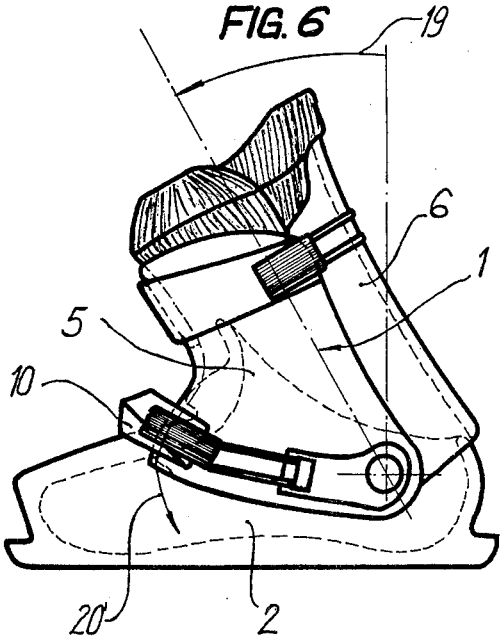
FIG. 6 is an elevational view of the boot according to the invention in the position of the foot bent forwards.
Figure 7:
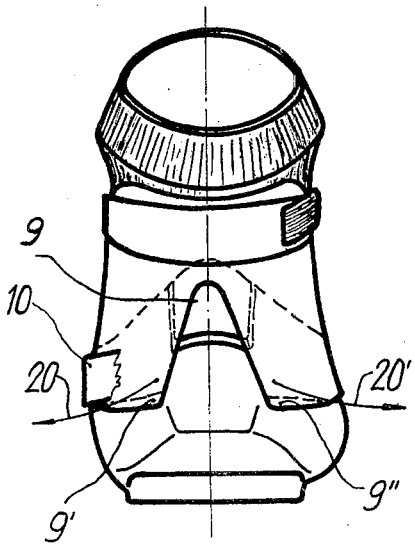
FIG. 7 is a front view of the boot in the same position as FIG. 6.

By means of the single operation of the closure device 11, which is unlocked, one eliminates the tension of the straps 10, 10' and at the same time the temporary deformation of the bottom of the front part 5 of the leg section 1, which returns to its initial position. One thus achieves the position facilitating walking illustrated in FIGS. 4 to 7, the lower part of the skier's leg still being retained by the leg portion 1 by virtue of the means 7, 8. In fact, in the area of the edges 9', 9'' of the slot and of the edge 14, the front part 5 has a shape such that the latter do not come into contact, either with the outer surface 16, or with the abutment 13 of the ball-and-socket joint 12. This feature of the invention has the result that the return to the stable initial state of the front part 5 of the leg portion, caused by unlocking of the resilient means 10, 10', 11 releases front part 5 from any abutment 13 and contacts 15, 16 with the foot section 2. Thus, in a longitudinal plane, the skier is able to carry out any pivotal movements of the foot with respect to the lower part of the leg. FIGS. 4 and 5 show the position of rearwards extension 18 of the foot achieved after the operation of unlocking the device 11, the leg portion 1 pivoting on the foot portion 2 by means of the pivots 3, 3'. When walking, this position of rearwards extension is normally followed by a normal upright position, then by a forwards bending position 19. The latter, illustrated in FIGS. 6 and 7, shows the position adopted by the front part 5 of the leg section on the front of the foot section 2. In this case, the separation between the initial stable shape of the bottom of the part 5 and the top of the foot section is used at least partly as the range of forwards bending movement. When the movement occurs for more pronounced bending, the deformable edges 9', 9'' of the slot 9 separate towards the outside in the direction of arrows 20, 20', by sliding on the top of the foot section 2, thus further increasing the amplitude of the bending movement 19.

As will be seen, the boot described above and produced according to the invention fulfils its role perfectly both as an alphine ski boot as well as a boot facilitating walking as regards the anatomy.

In the second embodiment (FIGS. 8 to 11) the boot designed in a similar manner to the former, is nevertheless distinguished therefrom by the fact that the front part 22 of the leg portion 21 comprises, in its front and lower portion, two slots 24 and 24' producing the deformation area of front part 22. As in the preceding case, these slots 24, 24' are open from the lower periphery of the part 22, but located laterally on either side of the area on top of the foot. The central portion 26 of the bottom of the part 22 located between the two slots 24, 24' comprises a lower edge 25 of L-shaped profile serving as a stop member, which is covered by the resilient means for controlling the deformation, constituted by resilient straps 10, 10' and the closure device 11. In order to obtain a good overlap of the stop edge 25, the strap 10 is also designed with an L-shaped profile in its central part 17. It is clear that any other guide means or positioning means adapted to any shape of the stop edge 25 are also valid. The tension produced at the time of locking the closure device 11 acts as in the case of the preceding embodiment, i.e. this tension acts directly on the deformable central part 26 whose inner side 27, which conforms with the outer side 16 of the ball-and-socket joint 12, comes into contact with the latter. The slots 24, 24' are thus in a contacted position and the deformable part 26 undergoes a temporary deformation, the consequence of which is the positioning of the stop edge 25 opposite the support abutment 13 of the ball-and-socket joint 12 (FIGS. 8 and 9).

The operation of the various parts of this boot, depending on their positions, is similar to that of the preceding example. In the position for skiing, the stop edge 25 lies flat against the abutment 13, at the time of leaning back. On the other hand, when leaning forward (for example when making a descent), the deformable central part 26 slides on the upper side 16 of the ball-and-socket joint 12, eliminating any contact with the abutment 13 and as the forwards bending movement continues, the edge 25 moves on the top of the foot portion 2, however, this movement being limited by the strap 10 which has a given elasticity and keeps said edge 25 in contact with the foot portion 2 while the slots 24, 24' separate gradually.

Figure 11:
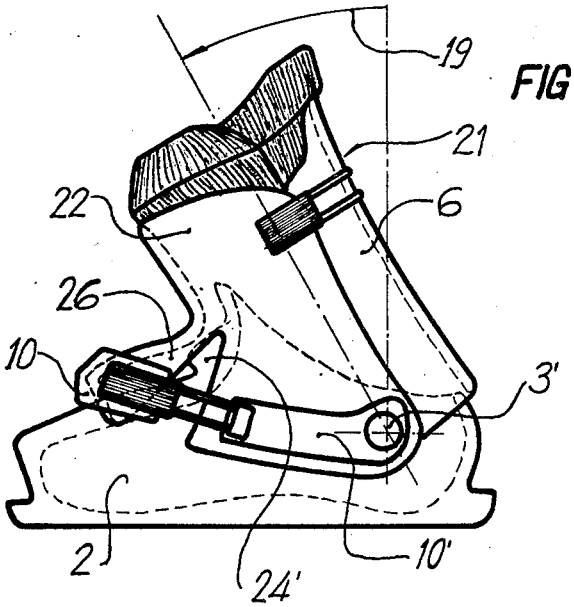
FIG. 11 is an elevational view of the boot according to the embodiment of FIG. 8, in the position of forward bending of the foot.

The position of the boot for walking (FIGS. 10 and 11) is obtained solely by operating the closure device 11, which is unlocked, thus eliminating any co-operation between the deformable central part 26 and the ball-and-socket joint 12 comprising an abutment located on the foot portion 2. This single operation of releasing the tension of the strap 10 simultaneously eliminates temporary deformation of the part 26 which resumes its stable initial shape such that no further contact is ensured with the foot portion apart from by the pivot 3, 3'. FIG. 10 shows the position of rearwards extension 18 obtained after unlocking the device 11 and it can be seen that the deformable part 26, which has resumed its stable initial shape, is separated from the ball-and-socket joint 12, whereas the slots 24, 24' are also separated. FIG. 11 shows the position of bending forwards 19, during which, with the leg portion 21 inclining forwards on the foot portion 2, the separation between the stable initial shape of the central deformable part 26 and the foot portion 2 is used at least partly as the amplitude of bending movement. Continuation of a more pronounced bending movement brings the part 26 of the front part 22 into contact with the top of the foot portion and deforms the latter more especially as the slots 24, 24' separate, which further increases the amplitude of the bending movement.

The boot described in this second embodiment thus makes it possible to carry out alpine skiing in an anatomical manner.

The two embodiments described are in no way limiting and modifications may be applied thereto without restricting the scope of the invention. Thus, the deformation areas of the bottom of the leg section provided by the slots may advantageously be replaced by areas of lesser thickness of material. Similarly, the resilient straps of L-shaped profile may be constituted by any other resilient means, such as, a spring, elastomer etc.

Finally, the boots according to the invention will not be restricted in their design, either to boots having a rear opening, or to constructions of the leg section having several parts, but could also be designed with leg sections in one-piece and with the boot opening at the side or at the rear.

What is claimed is:

1. A ski boot comprising at least two parts including a lower part comprising a foot section and an upper part, means pivotably connecting the upper and lower parts, said upper part comprising a leg section including at least one part, said upper part including at least one deformation region constituted by the provision of at least one slot open from the lower periphery of the leg section and defining at least one flexible tongue to permit the two parts of the boot to cooperate with each other, and resilient means for controlling the deformation of said region, said resilient means having two states, including a first state in a position of the boot suitable for skiing in which the resilient means ensures the locking, at least towards the rear of the upper part on the lower part, and a second state in a position of the boot suitable for walking in which due solely to the operation of the resilient means, it allows at least partial elimination of the cooperation between the deformation region provided on said upper part and the lower part, as well as elimination of the aforesaid locking.

2. A ski boot according to claim 1, in which said deformation region is centrally provided at the lower and front part of the leg section.

3. A ski boot according to claim 1, in which said deformation region is laterally provided at the lower part of the leg section.

4. A ski boot according to claim 1, in which on its upper surface, the foot section comprises a protuberance limited at the front by a shoulder acting as a support abutment, said deformation region being on said leg section in its lower part and normally bearing on the protuberance, said resilient means extending above the lower part of said deformation region and normally retaining the latter against said protuberance of the foot section, said means pivotably connecting the upper and lower parts comprising first and second transverse pivots connecting said upper and lower parts, said resilient means comprising a first strap of resilient material having one side connected to the boot in the region of one of said transverse pivots, a second strap of resilient material connected to the boot in the region of the other transverse pivot, and a closure means connecting said straps.

5. A ski boot according to claim 4, in which in its central part located above the protuberance the strap has a substantially L-shaped profile covering, in the skiing position, the lower edge of the leg section, which is folded downwards substantially in an L-shape, in order to maintain the latter against the front shoulder of the protuberance forming a rear abutment.

6. A ski boot according to claim 5, in which in its lower and front part, the leg section has a central slot extending from the lower periphery of the leg section upwards and rearwards and located above the protuberance.

7. A ski boot according to claim 4, in ehich in its front and lower part, the leg section has two slots extending from the lower periphery of the leg section and defining therebetween a central tongue whose inner side is pressed against the outer side of the protuberance.

8. A ski boot according to claim 1, in which the resilient means for controlling the deformation of the area is independent of the bottom of the leg section.

9. A ski boot according to claim 1, in which in the position suitable for walking, the lower part of the skier's leg is retained in the leg section.

* * * * *

UNITED STATES PATENT AND TRADEMARK OFFICE

CERTIFICATE OF CORRECTION

PATENT NO. : 4,186,501

DATED : FEBRUARY 5, 1980

INVENTOR(S) : GEORGE P.J. SALOMON

It is certified that error appears in the above-identified patent and that said Letters Patent are hereby corrected as shown below:

In the heading insert:

Foreign Application Priority Data

November 19, 1976 France 76 34857

Signed and Sealed this

*Tenth* Day of *June 1980*

[SEAL]

*Attest:*

SIDNEY A. DIAMOND

*Attesting Officer*

*Commissioner of Patents and Trademarks*